United States Patent [19]

Folk et al.

[11] 4,043,017

[45] Aug. 23, 1977

[54] APPARATUS FOR INSERTING WIRES INTO TERMINALS AND FOR MANUFACTURING ELECTRICAL HARNESSES

[75] Inventors: Kenneth Foster Folk; Milton Dean Ross; Walter Clifton Shatto, Jr., all of Harrisburg, Pa.

[73] Assignee: AMP Incorporated, Harrisburg, Pa.

[21] Appl. No.: 657,138

[22] Filed: Feb. 11, 1976

[51] Int. Cl.[2] ..... H01R 43/04

[52] U.S. Cl. ..... 29/749; 29/759

[58] Field of Search ..... 29/203 D, 203 DS, 203 DT, 29/203 MW, 203 P, 203 J, 203 S

[56] References Cited

U.S. PATENT DOCUMENTS

| | | | |
|---|---|---|---|
| 3,791,008 | 2/1974 | Dyksterhouse | 29/203 P |
| 3,887,999 | 6/1975 | Ross et al. | 29/203 P |
| 3,953,916 | 5/1976 | Rolland et al. | 29/203 J |

*Primary Examiner*—Robert Louis Spruill

*Attorney, Agent, or Firm*—Frederick W. Raring; Robert W. Pitts; Jay L. Seitchik

[57] ABSTRACT

Apparatus for inserting wires into terminals comprises a templet plate having wire-receiving slots extending therethrough from one surface to the opposite surface. The slots extend to one edge of the plate so that wires positioned on one surface adjacent to the edge will, when pressed progressively against the surface, move into the slots. Inserters move through the slots and insert the wires into a connector positioned under the other face of the templet. In accordance with a further aspect of the disclosure, a shuttle type wire feed is provided in combination with the templet plate and a second wire insertion apparatus is provided to produce electrical harnesses.

14 Claims, 16 Drawing Figures

Fig. 8
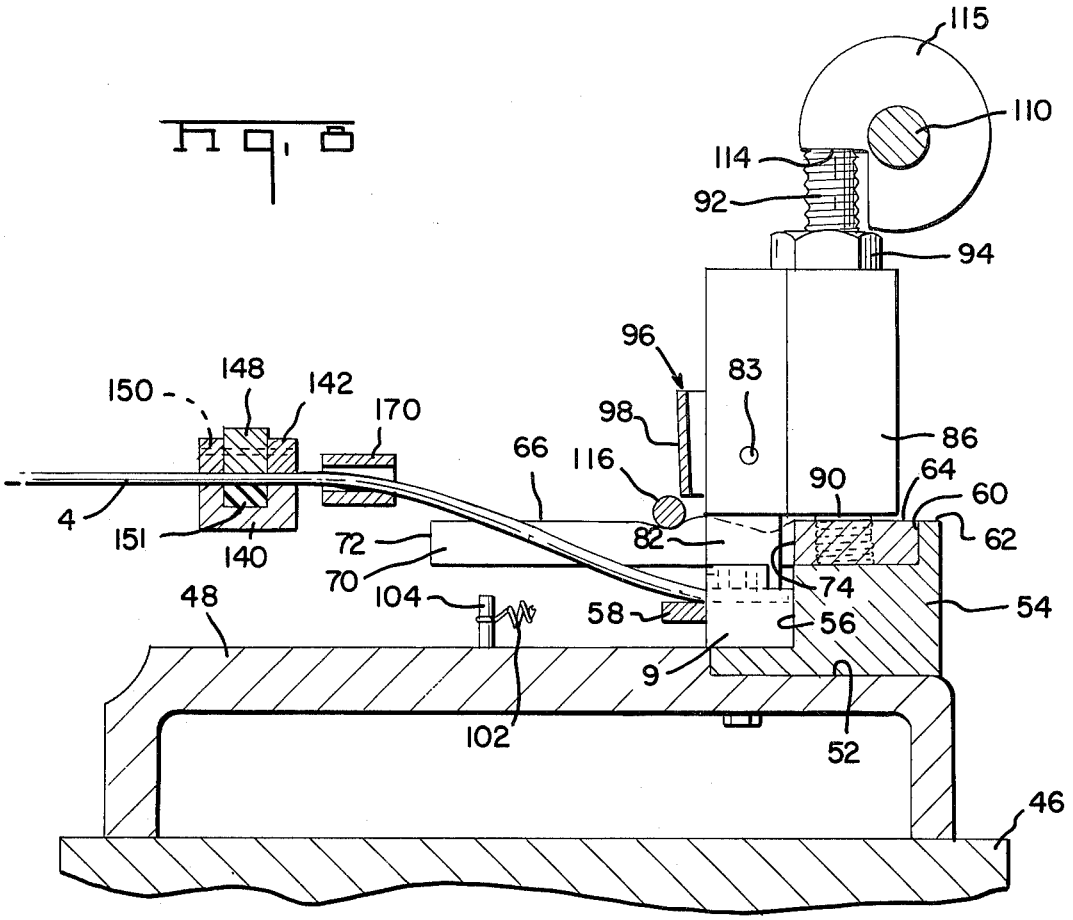
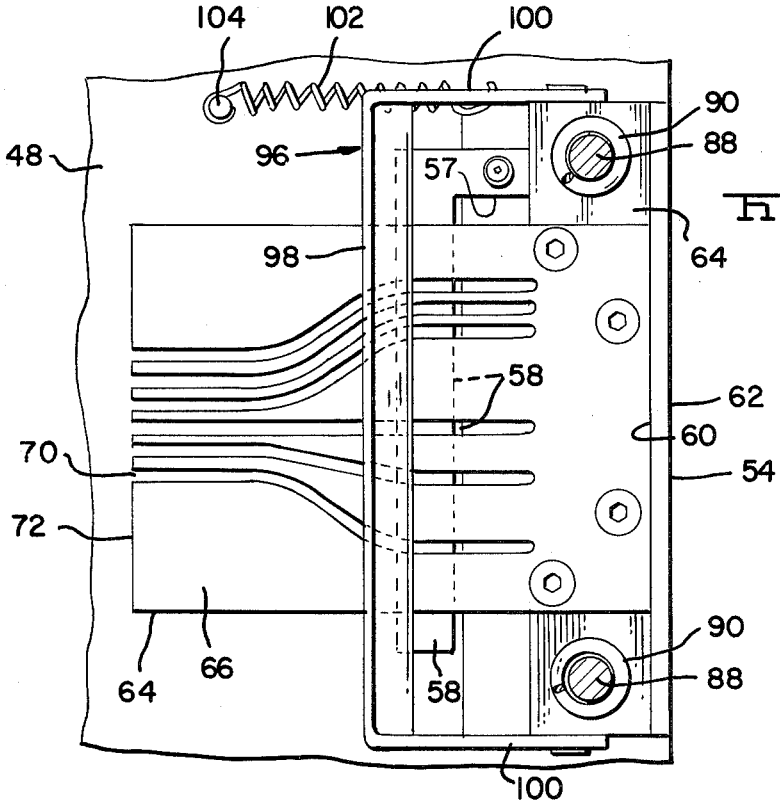
Fig. 10

46
196
194
192
190
200
202
206
210
9'
208
204
214
36
230
232
224
240
242
225
220
226
228
170
182
218
9B
4
142
140
148
151
150
216
128
174
178
179
176
180
172

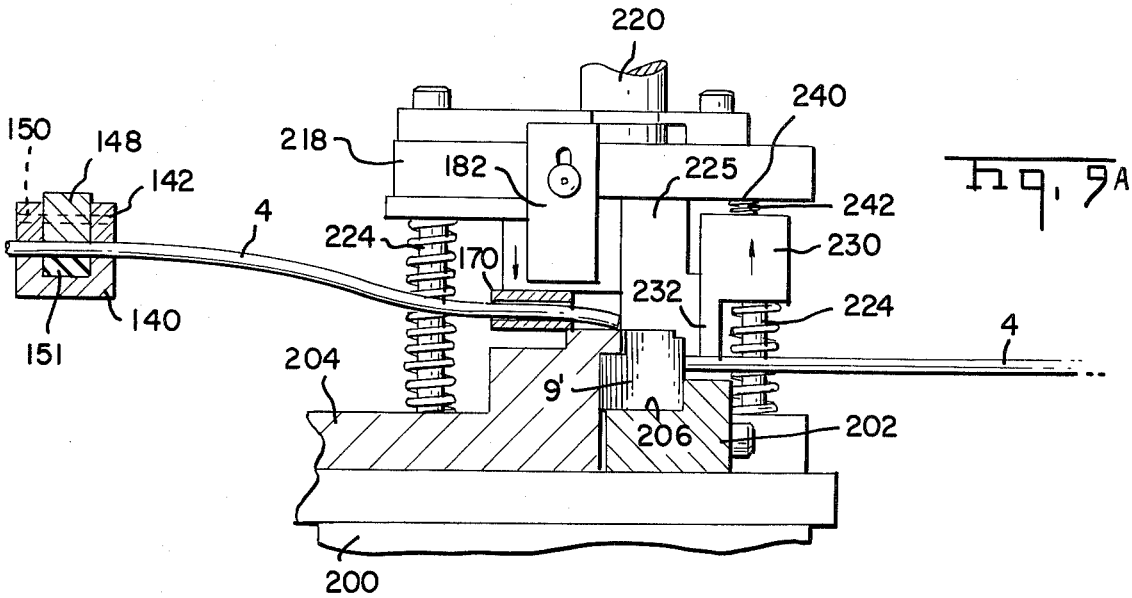
Fig. 9A
Fig. 11
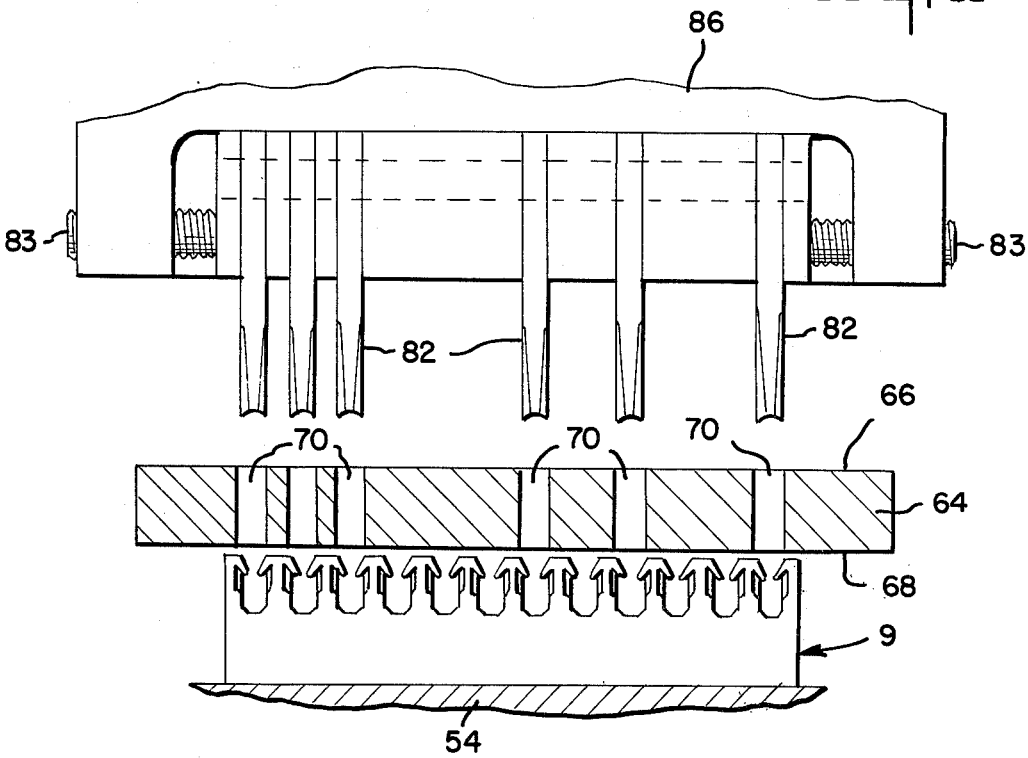

APPARATUS FOR INSERTING WIRES INTO TERMINALS AND FOR MANUFACTURING ELECTRICAL HARNESSES

BACKGROUND OF THE INVENTION

U.S. Pat. Nos. 3,871,072, 3,874,077 and 3,891,013 disclose and claim an apparatus for precisely positioning the end portions of each of a plurality of wires at spaced apart locations in preparation for attachment of terminals to the wires. U.S. Pat. No. 3,871,072 particularly discloses an apparatus having associated with the wire positioning means a crimping means for securing the precisely positioned wires to terminals.

In accordance with one aspect of the instant invention, an improved apparatus is provided which has wire positioning means as disclosed in the above-identified U.S. Patents in combination with wire insertion means for inserting wires into the wire receiving portions of contact terminals which are contained in an electrical connector or the like. The wire-positioning means comprises a templet plate having slots extending inwardly from one edge thereof and extending completely through a plate between oppositely directed surfaces thereof. When the wires are located adjacent to the one edge and rolled over or pressed against, and over, one surface of the plate, the wires locate themselves in the slots. Thereafter, an insertion means moves into the slots and inserts end portions of the wires in the wire receiving portions of terminals which are contained in a connector which is against the opposite surface of the templet plate. In accordance with this aspect of the invention, each wire of a plurality of wires can be precisely located and inserted into the terminals in a connector even though the terminals are not spaced apart by uniform distances.

In accordance with a further aspect of the invention, there is provided a feed shuttle means for feeding wires along a predetermined path to the templet plate which is briefly described above. A second insertion apparatus is provided on this feed path so that the feed wires which have been inserted into one connector located beneath the templet plate can be also inserted into a second connector which is remote from the templet plate. An apparatus in accordance with this aspect of the invention is thus capable of producing electrical harnesses having two or more connectors and wires extending between the terminals in the connectors.

It is accordingly an object of the invention to provide an improved harness making apparatus. A further object is to provide an apparatus for inserting the ends of wires into terminals in an electrical connector. A further object is to provide an apparatus capable of inserting wires into non-uniformly spaced terminals in a connector. A further object is to provide and disclose wire handling principles which can be used under a wide variety of circumstances in the harness manufacturing industry; for example, in the design of specialized harnesses making machines for producing harnesses at a rapid rate and at low cost.

These and other objects of the invention are achieved in preferred embodiments thereof which are briefly described in the foregoing abstract, which are described in detail below, and which are shown in the accompanying drawing in which:

FIG. 3 is a perspective view of a preferred form of apparatus in accordance with the invention.

FIG. 5 is a frontal view of the second wire inserting station at which the wire positioning templet is located, this view being a fragmentary view of the essential structural elements of the second wire insertion station showing the positions of the parts during the final stages of feeding wire to this station.

FIGS. 6, 7 and 8 are views similar to FIG. 5 but showing the positions of the parts during positioning of the wires in the templet plate and insertion of the wires into a connector.

FIG. 9A is a view similar to FIG. 9 but showing the positions of the parts at the time of insertion of the wires.

FIGS. 10 and 11 are views taken along the lines 10—10 and 11—11 of FIG. 5.

Figure 12:
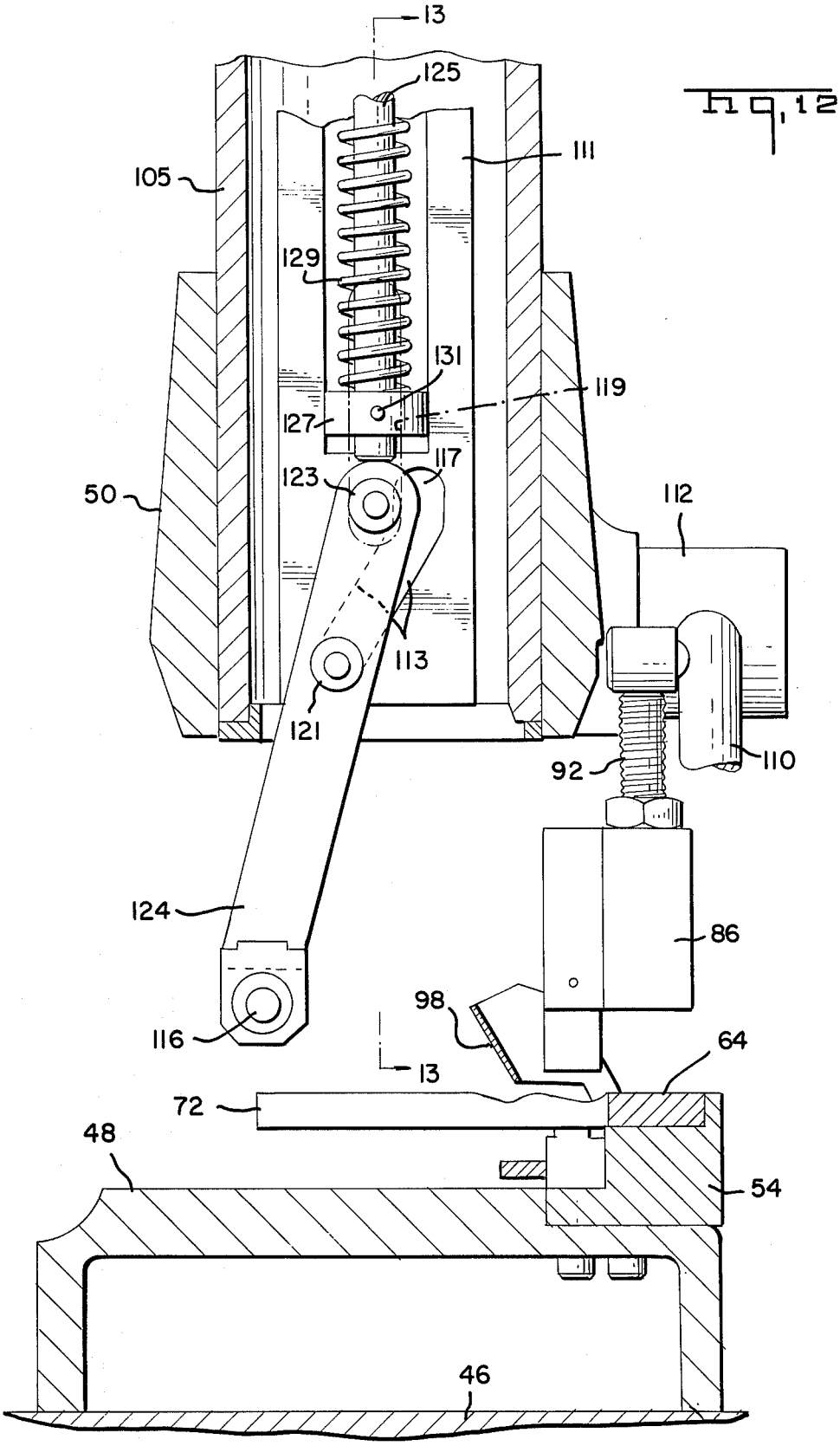
Figure 13:
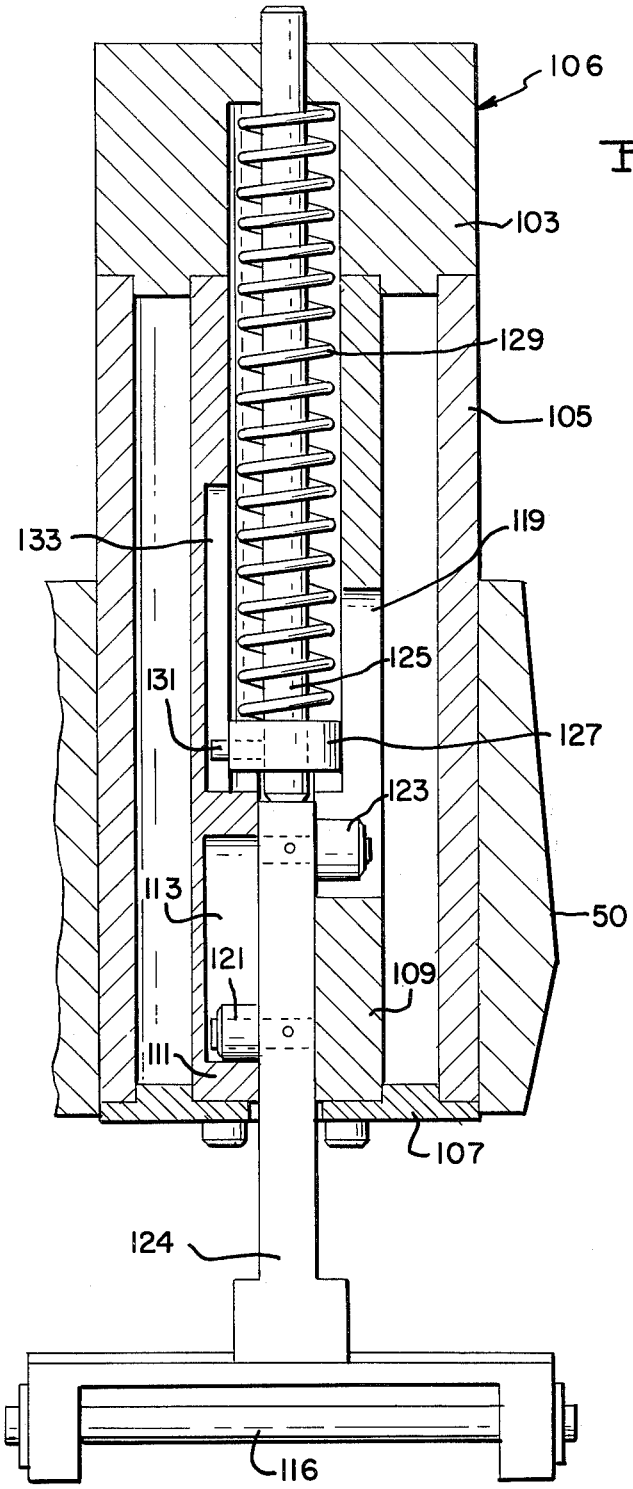

FIGS. 12 and 13 are views showing the internal construction of the press ram.

Figure 14:
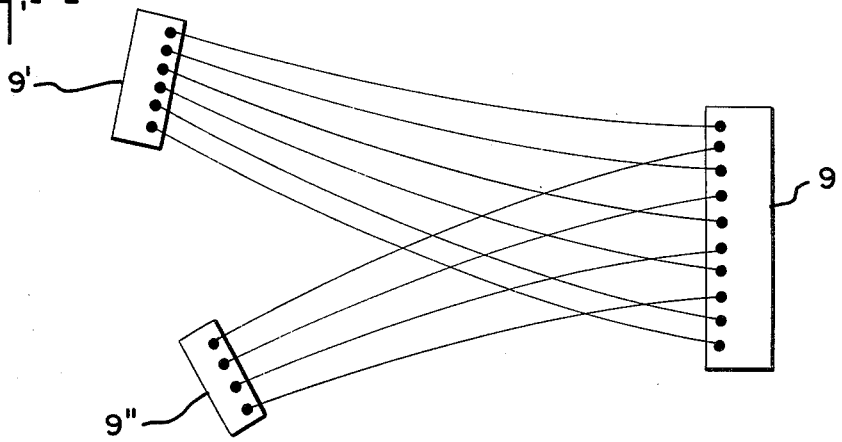

FIG. 14 is a diagrammatic view of an another form of electrical harness which can be produced by the apparatus of the disclosed embodiment.

Figure 1:
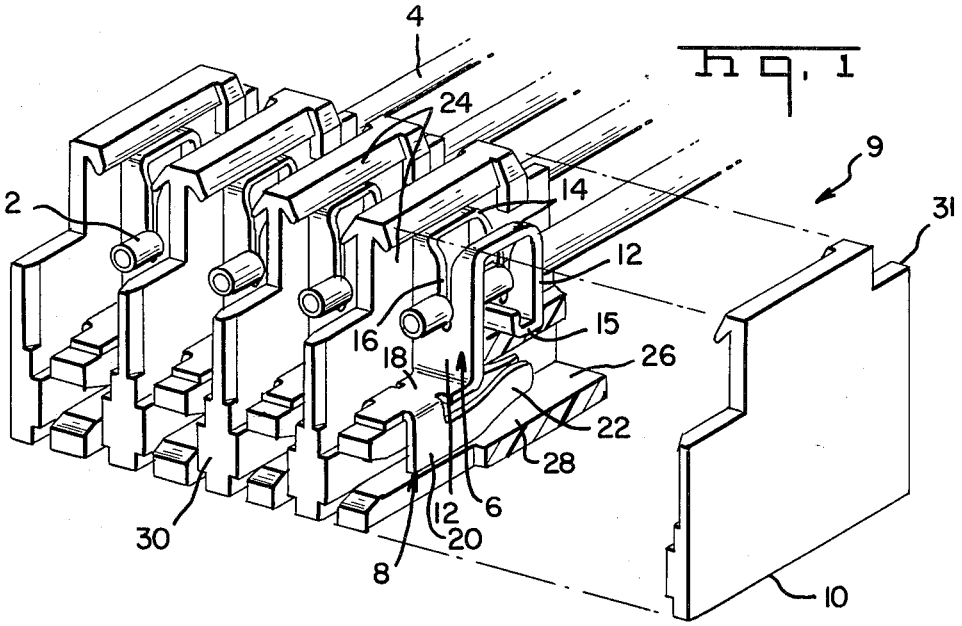
FIG. 1 is a perspective view of one type of multicontact electrical connector which can be used with the apparatus of the disclosed embodiment.
Figure 2:
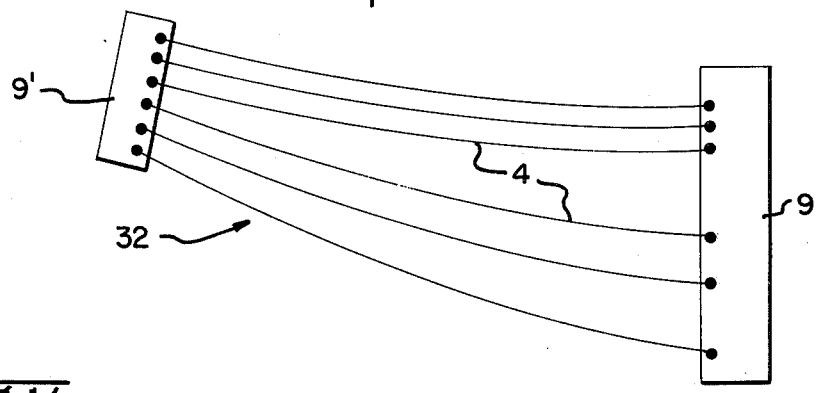
FIG. 2 is a diagramatic view of a relatively simple electrical harness which can be produced by the apparatus of the disclosed embodiment.

The invention is generally directed to the insertion wires into the wire receiving portions of terminals which are contained in an electrical connector and the herein disclosed embodiment is further directed to the manufacture of electrical harnesses as shown in FIGS. 2 and 14. The connectors may be of any desired configuration and may be of different types known to the art. The disclosed embodiment is specifically intended to insert the ends 2 of wires 4 into the wire receiving portions 6 of terminals 8 which are contained in a connector shown at 9 in FIG. 1.

Each terminal 8 has a pair of spaced apart plate like sections 12 which are connected at their upper ends by strap members 14 and which are provided with aligned slots 16 for reception of the wires. The slots have a width which is less than the diameter of the conducting core of a wire so that upon insertion, the edges of the slot will penetrate the insulation of the wire and establish electrical contact with the conducting core. In the disclosed embodiment, the rearward plate section 12 has a reversely extending arm 15 integral therewith which bears against the front plate section for strengthening purposes. This front plate section has a forwardly extending tongue 18 from the edges of which their extend depending arms 20. Contact springs 22 extend from these arms beneath the wire receiving portion 16, these contact springs being adapted to receive a terminal post in a printed circuit board or the like.

The housing 10 of the connector is generally prismatic and has spaced apart barrier walls 24 on its upper side between which the wire receiving portions 6 of the terminals are mounted. The upper side is recessed as shown at 26 and the wire receiving portions 6 and tongues 18 are contained in these recesses. The contact springs 22 extend through aligned openings or passageways 28 which extend through the housing from the oppositely directed sides 30, 31 thereof. As shown in FIG. 1, the wires 4 extend towards the side 31 of the housing and each wire extends between an adjacent pair of barrier walls 24 with the end of the wire disposed in the wire receiving slots of the terminal.

FIG. 2 shows an electrical harness which is composed of connectors 9, 9' and wires 4 extending between connectors. The connector 9' has a number of terminals or "positions" therein which is equal to the number of wires in the harness and each terminal in connector 9' has connected thereto one of the wires 4. The connector 9 has a number of positions which is substantially greater than the number of wires 4 and the wires extend to predetermined terminals which are non-uniformly spaced apart. As will be explained below, the wire positioning templet and insert means in accordance with the invention is capable of inserting wires into any of the terminals in the connector 9.

Figure 4:
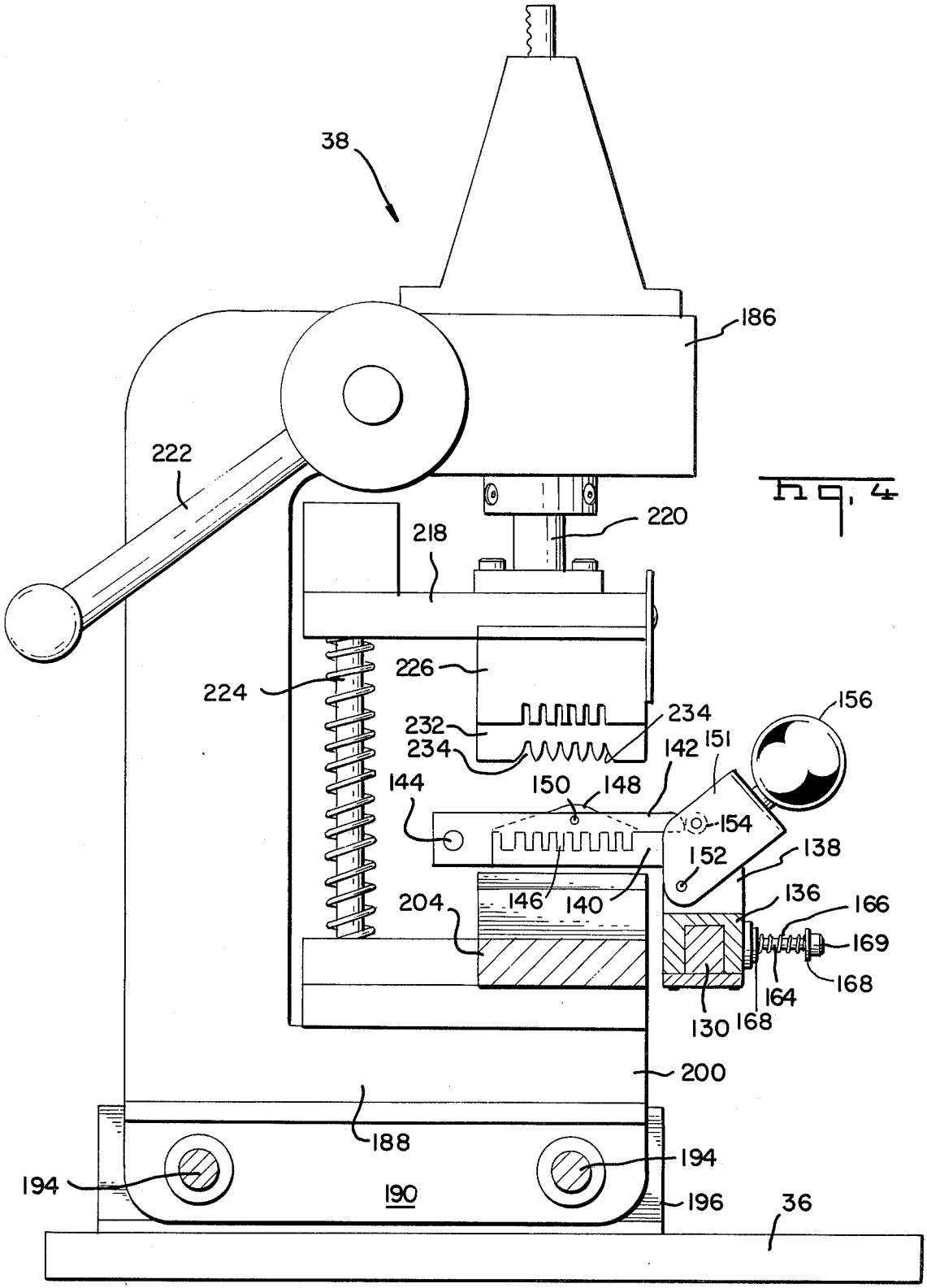
FIG. 4 is a side view of one of the wire insertion stations of the apparatus of FIG. 3.
Figure 7:
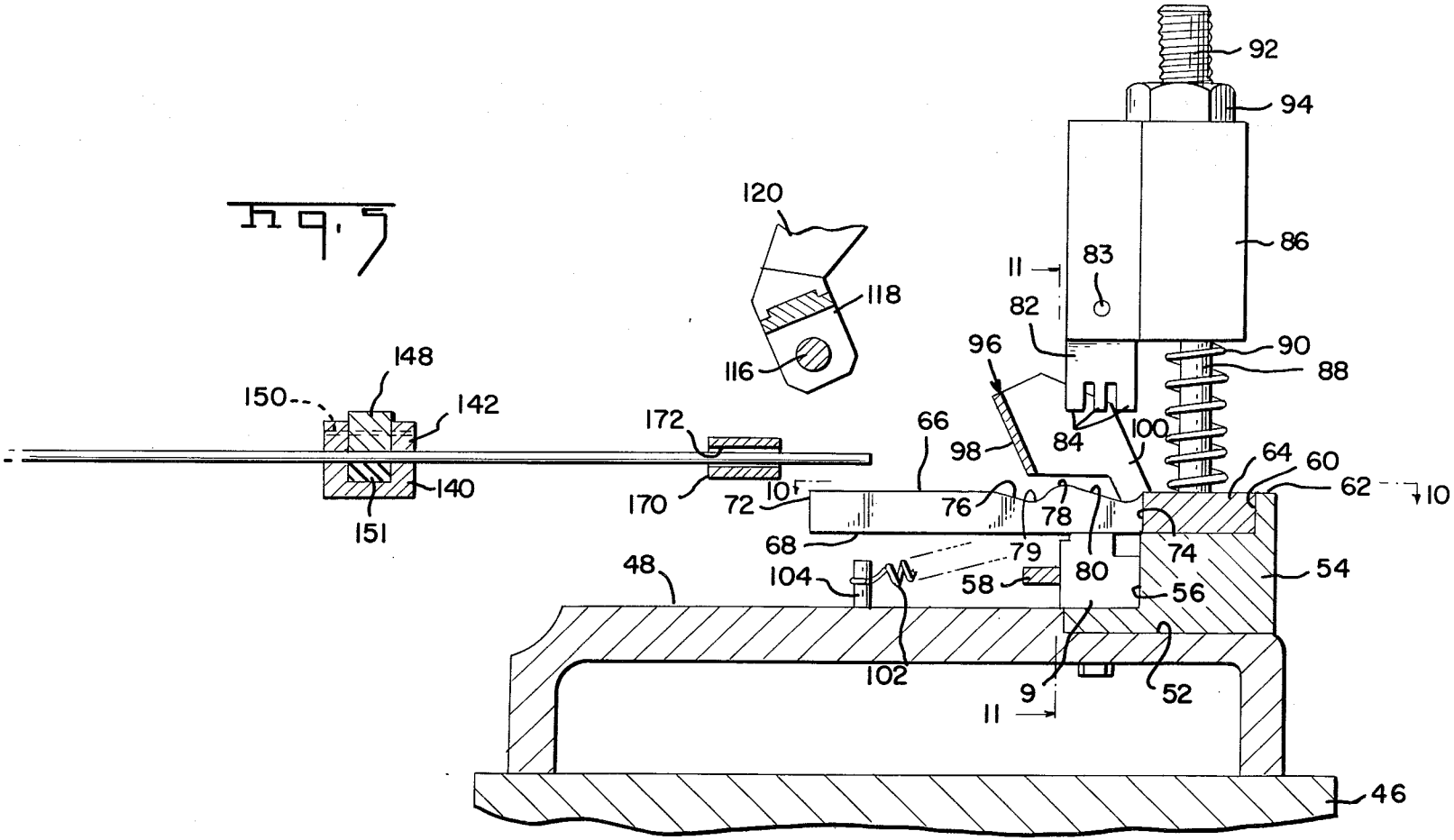

Turning now to FIGS. 3–5, a preferred apparatus 34 in accordance with the invention comprises a base plate 36 on which there are provided first and second wire inserting stations 38, 40 respectively. The wires 4 are inserted into the connector 9' at the first station 38 and into the connector 9 at the second station 40. The manufacturing process for the harness shown in FIG. 2 is to first feed the wires 4 and this is done by pulling the wires in side by side parallel relationship from endless sources, such as barrels, by a manually reciprocable shuttle assembly 42, past the first insertion station and to the second station. The wires are then inserted into the connector 9 at the second insertion station 40. Thereafter, the wires are set at a location adjacent to the first insertion station 38 and inserted into the connector 9'. In the description presented below of the entire apparatus, a detailed description is presented first of the second insertion station 40 which is followed by a detailed description of the feed shuttle means. Finally, the first insertion station is described in detail.

The second station has a press frame 44 mounted on a support block 46 which in turn is mounted on base plate 36. The press has a lower arm on which there is provided a support surface 48 and an upper arm 50 in which a ram 106 is slidably mounted. The support surface 48 (FIG. 5) is cut away on its righthand side as shown at 52 and a mounting block 54 is secured in a recess on the surface. Block 54 is itself recessed on its lefthand side to provide a shoulder 56 against which the side 30 of the connector housing is positioned. The connector 9 is also located on the block 54 by an arm 57 of a positioning bar 58 which is adjacent to the neck portion of the press frame (see FIG. 10). Finally, the connector 9 is located in the position shown in FIG. 5 by the portion of the positioning bar 58 which extends transversely across the surface 48 and has an end portion secured by a suitable fastener to the block 54.

The connector 9 is thus precisely located on the block 54 with predetermined terminal positions on the upper side of the housing in alignment with a templet plate 64. The templet plate is generally flat and is mounted in a recess 60 extending inwardly from the upper side or surface of block 54. Plate 64 extends leftwardly, as viewed in FIG. 5, and has upper and lower surfaces 66, 68 and an outer edge 72 which is remote from the block 54. A plurality of wire-receiving grooves 70 extend inwardly from the edge 72 towards the block 54 and have inner ends or dead ends, 74 which are adjacent to, and immediately above predetermined terminal positions in the connector 9. These grooves 70 extend entirely through the block from the upper surface 66 to the lower surface 68 and are of a width such that an individual wire can pass laterally through each groove. The upper surface 66 of the plate 64 has a transversely extending valley 79 and an adjoining ridge 78 which is adjacent to, but spaced from, the inner ends 74 of the grooves. The portion of the surface 66 which extends from the ridge 78 rightwardly to the inner ends 74 is inclined downwardly as shown at 80. The profile defined by these irregularities facilitates movement of the wires through the grooves as will be explained below.

After the wires have been positioned in the grooves 70, they are moved through the grooves and into terminals in the connector 9 by wire insertion punches 82 which are mounted on a crosshead 86. Each of the punches has three depending fingers 84, the center one of which moves between the strap portions of a terminal while the end fingers straddle the two plate-like sections 12 of the terminal. During downward movement of the punches, the ends of these fingers thus push the wires into the wire-receiving slots of the terminals. The punches are located on the crosshead in side-by-side spaced apart relationship by suitable spacers and secured in position by a mounting pin 83 as shown. The punches are located such that they will move through the individual grooves 70 in which wires have been positioned so as to insert the wires into specifically predetermined terminals in the connector 9.

The crosshead 86 is slidably mounted on spaced apart guide posts 88 which are secured in, and extend upwardly from, the upper surface 62 of block 54 on each side of the righthand end of the templet plate 64. Crosshead 86 is normally biased upwardly to the position shown in FIG. 5 by springs 90 and it can be moved downwardly during insertion against the biasing force of these springs. A stud 92 is threaded into the upper surface of the crosshead and a nut 94 is threaded onto the stud. This nut is engaged by a collar when the press is actuated to lower the crosshead. The shut height (i.e. the bottomed position) of the crosshead and the insertion punches can therefore be set by changing the position of the nut 94.

It is desirable to provide a wire deflector 96 on the block 54 to ensure proper positioning of the wires in the grooves 70. This deflector comprises a deflector bar 98 which extends transversely across, and is spaced from, the upper surface 66 of the templet plate 64. Bar 98 extends downwardly and rightwardly as viewed in FIG. 5 so that it will deflect wires downwardly and it has arms 100 extending from its ends which are pivotally mounted on pins in the block 54. The deflector 96 is resilient biased in a counterclockwise position as shown in FIG. 5 by a spring 102 which is hooked at one end thereof to one of the arms 100 and is connected at its other end to a pin 104. The deflector can be swung upwardly from the position shown during movement of a roller (described below) across the surface 66.

The reciprocable ram 106 of the press at the second insertion station is mounted in the upper arm 50 of the press frame and has gear teeth (not specifically shown) which are in engagement with a gear on the shaft 108 journalled in the press frame. A collar 112 is mounted on shaft 108 and a crank handle 110 extends from this collar so that from turning the handle in a counterclockwise direction as viewed from the right in FIG. 3, the ram 106 will be moved downwardly from the position shown.

A collar 115 is provided on the crank handle 110 and this collar is notched as shown at 114, FIG. 8. When the crank handle is swung through a counterclockwise arc from the position of FIG. 3, the notch 114 moves against the upper end of the stud 92 and lowers the crosshead as shown in FIG. 8.

Figure 7:
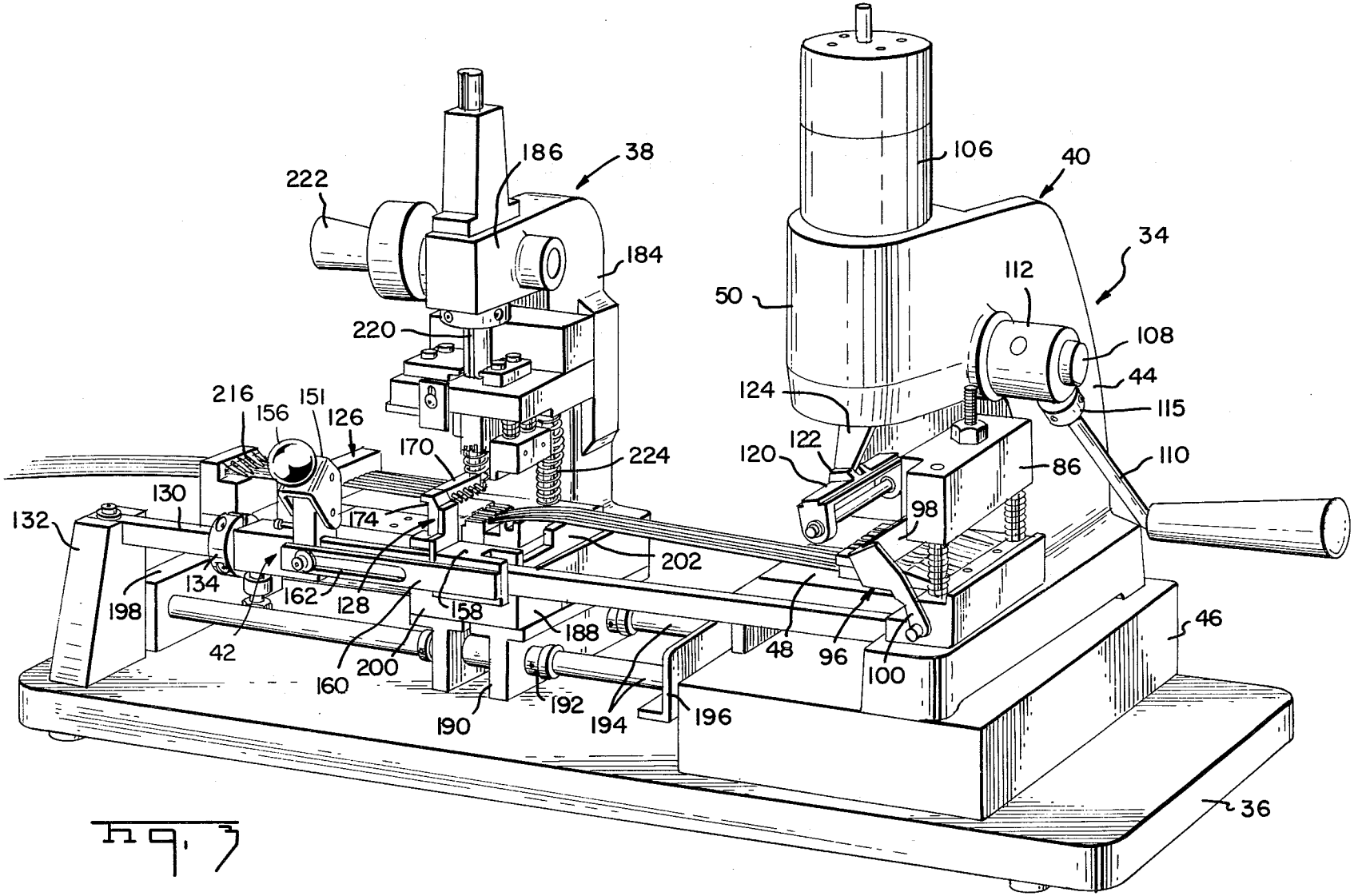
Figure 6:
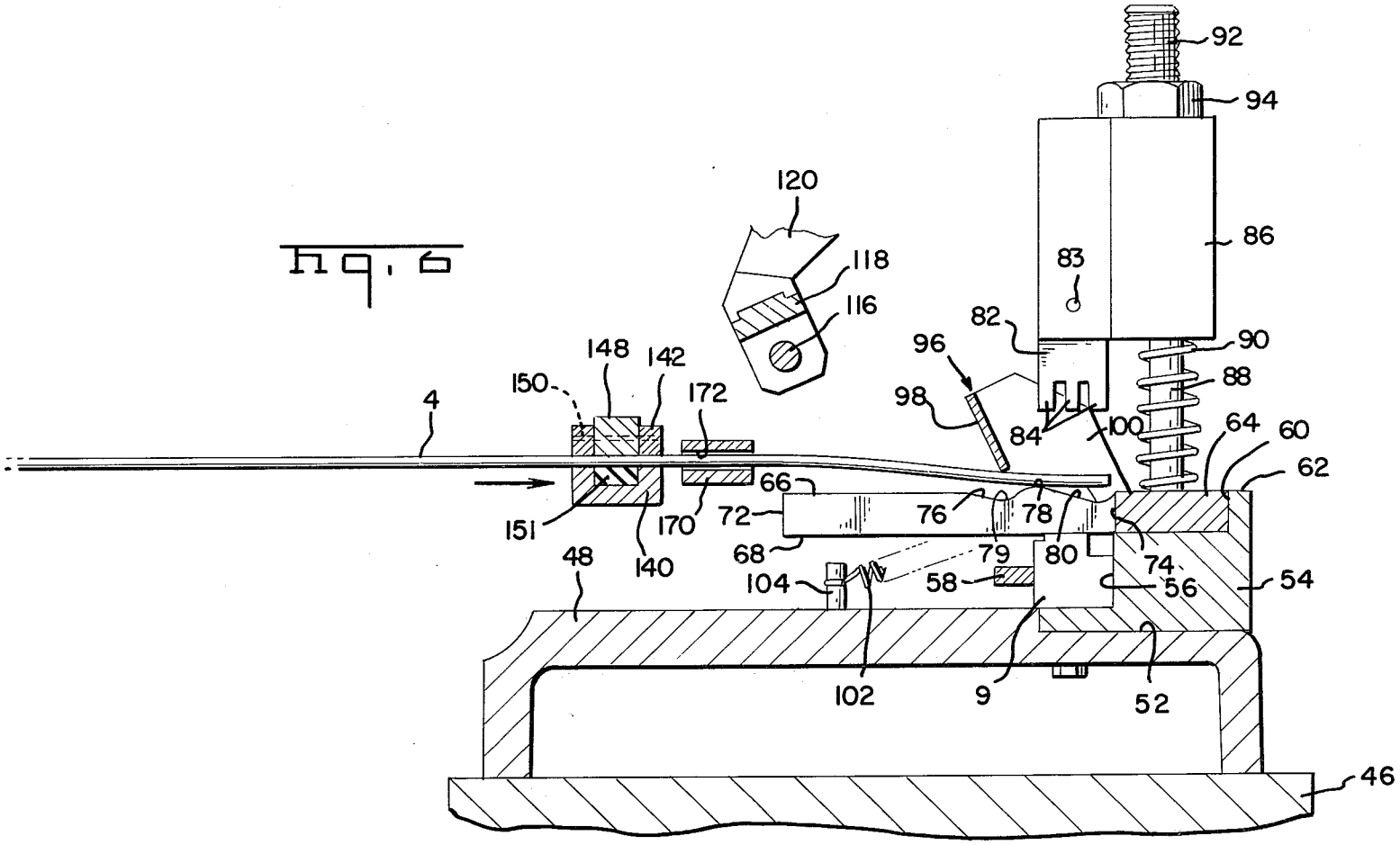
Figure 7:
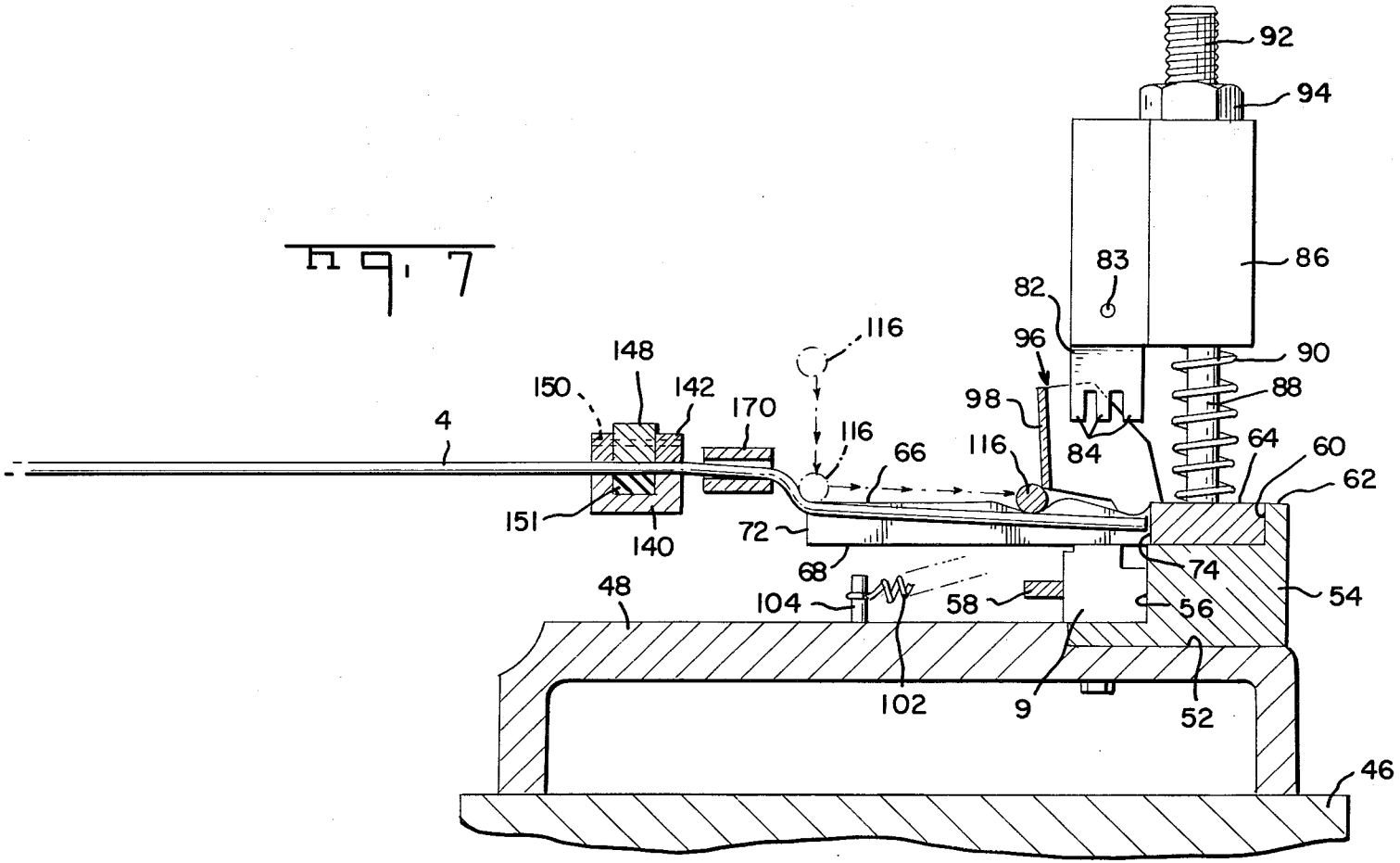

It will be apparent from FIGS. 5 and 6 that the wires 4 are fed rightwardly by the feed shuttle, which is described below, until they are above the upper surface 66 of the templet plate. The surface of the deflector bar 98 deflects the wires downwardly so that they are adjacent to the templet plate, however, the wires at this stage have not been positioned in the grooves of the templet. The wires are moved into the grooves by a roller 116 which is normally located, as shown in FIG. 6, with its axis extending transversely across, and spaced above, the templet plate. As shown in FIGS. 7 and 8, this roller is first moved downwardly (FIG. 7) until it is on the upper surface of the templet and it passes the wires into the portions of the grooves 70 which are immediately adjacent to the edge 72. The roller then moves rightwardly as viewed in FIG. 7 until it is disposed in the valley 76 and during such movement, each wire is moved downwardly into its respective groove. The grooves are not parallel, as noted above, and the inner ends are spaced apart by varying distances so that the wires are splayed during such movement and their ends are located immediately above the terminals in the connector 9 into which they are to be inserted.

Roller 116 extends between the spaced apart arms 118 of a yoke 120. The yoke is mounted in the interior of the ram and controlled by a camming mechanism (described below) which causes the roller to move vertically downwardly from the upper position of FIG. 6 to the lowered position in FIG. 7 and then rightwardly in FIG. 7 and into the valley 76. It will be noted that when the roller moves into the valley 76, it swings the deflector bar 98 through a slight arc, and the end portions of the wires will then be disposed at the inner ends 74 of the slots 70. The valley 76 thus causes the wires to be lowered beneath the surface 66 of the templet plate and their ends are located adjacent to the upper surface of the connector 9.

Referring now to FIGS. 12 and 13, the press ram 106 comprises a cap portion 103, a hollow cylindrical body 105, and a lower cover 107. Opposed flat parallel camming plates 109, 113 are contained in the body and held by the opposed surfaces of the cap and the lower cover 107. The plate 111 has a camming slot 113 therein which extends diagonally from a location adjacent to the lower end of the plate upwardly and the end portion 117 of this slot extends vertically or parallel to the direction of movement of the ram. This camming slot receives a roller 121 on one side of the arm 124 on which the wire roller 116 is mounted. The plate 109 has a vertically extending slot 119 which receives a roller 123 on the arm 124. The arm 124 is received freely between the opposed surfaces of the plates 109, 111 but is biased downwardly by a rod 125 which extends through the cap member 103 and bears against the upper end of the arm 124. Rod 125 is biased downwardly by a spring 129 which extends into a counterbore in the cap 103 and which bears against a nut 127 on the lower end of the rod 125. Advantageously, a pin 131 is provided on this nut and extends into a slot 133 in the plate 111 so that the degree of compression of the spring 129 can be changed by rotating the rod; upon such rotation, the nut will move along the threaded rod since it is restrained against rotation by the pin 131.

The normal position of the ram is as shown in FIG. 3 and when the ram is lowered, the arm 124 moves downwardly with the ram until the roller 116 is against the upper surface 66 of the templet plate. Thereafter, and upon further downward movement of the ram, the plates 109, 111 move downwardly relative to the arm 124 and the upper end of the arm is caused to swing towards the axis of the ram by the camming surface 113 and the slot 119. The relative movement of the slot 113 past the roller 121 thus produces the rolling motion of the wire roller across the templet plate until the roller enters the vertically extending section 117 of the cam slot. This vertically extending section of the cam slot causes the roller to dwell very briefly during the final portion of the downward stroke of the ram and it is during this dwell interval at the collar 115 engages the crosshead 86 to drive the inserters 82 through the templet plate.

The shuttle assembly for feeding the wires comprises, as shown in FIG. 3, a wire clamp assembly 126 and a wire guide assembly 128 which is disposed forwardly of the clamp assembly. Both the clamp and guide assemblies are slidably mounted on a guide bar 130 which is supported in a bracket 132 at the lefthand end of plate 36 and extends to and is supported on, the lower arm of the press 50. Leftward movement of the shuttle assembly on the bar 130 is limited by an selectively positionable collar 134 on the bar 130.

The wire clamp assembly 126 is supported on a slidable support carriage 136 on the bar 130 as shown in FIG. 4. This slidable carriage has an upwardly extending arm 138 and a fixed clamping arm 140 extends inwardly from this support and transversely of the wires which are to be fed. A movable wire clamp arm 142 is pivoted at 144 to the free end of fixed arm 140 so that the movable arm 142 can be swung upwardly through a limited arc with respect to its pivotal axis. The fixed arm has spaced-apart notches 146 for the individual wires and the movable arm has a recess extending therethrough in which a generally triangular clamping bar 148 is mounted on a pin 150 which extends through the apex of the clamping bar. When wires are positioned in the notches 146, they can be firmly clamped in the arm 140 by swinging the arm 142 downwardly until the lower edge of the clamping bar 148 is against the wires. Advantageously, a rubber insert 151 is provided in the arm 140 and the wires are clamped against this insert by the arm 142 as shown in FIG. 5.

The arm 142 can be clamped in its lowered position to hold the wires on the fixed arm by a clamping or locking member 151 which is pivoted at 152 to the upwardly extending arm 138 of the carriage 136. Locking member 151 is generally U-shaped and straddles the arms 140, 142. A locking roller 154 extends between the sidewalls of the locking member 151 so that when the locking member is swung through a counterclockwise arc from the position shown in FIG. 4, this roller will move over the controlled surface at the righthand end of the arm 142 and cam it downwardly and through a clockwise arc about its pivotal axis 144. Advantageously, a knob 156 is provided on the web of the locking member 151 to facilitate clamping and unclamping of the wires when the locking member is swung in either direction.

Figures 9, 9B:
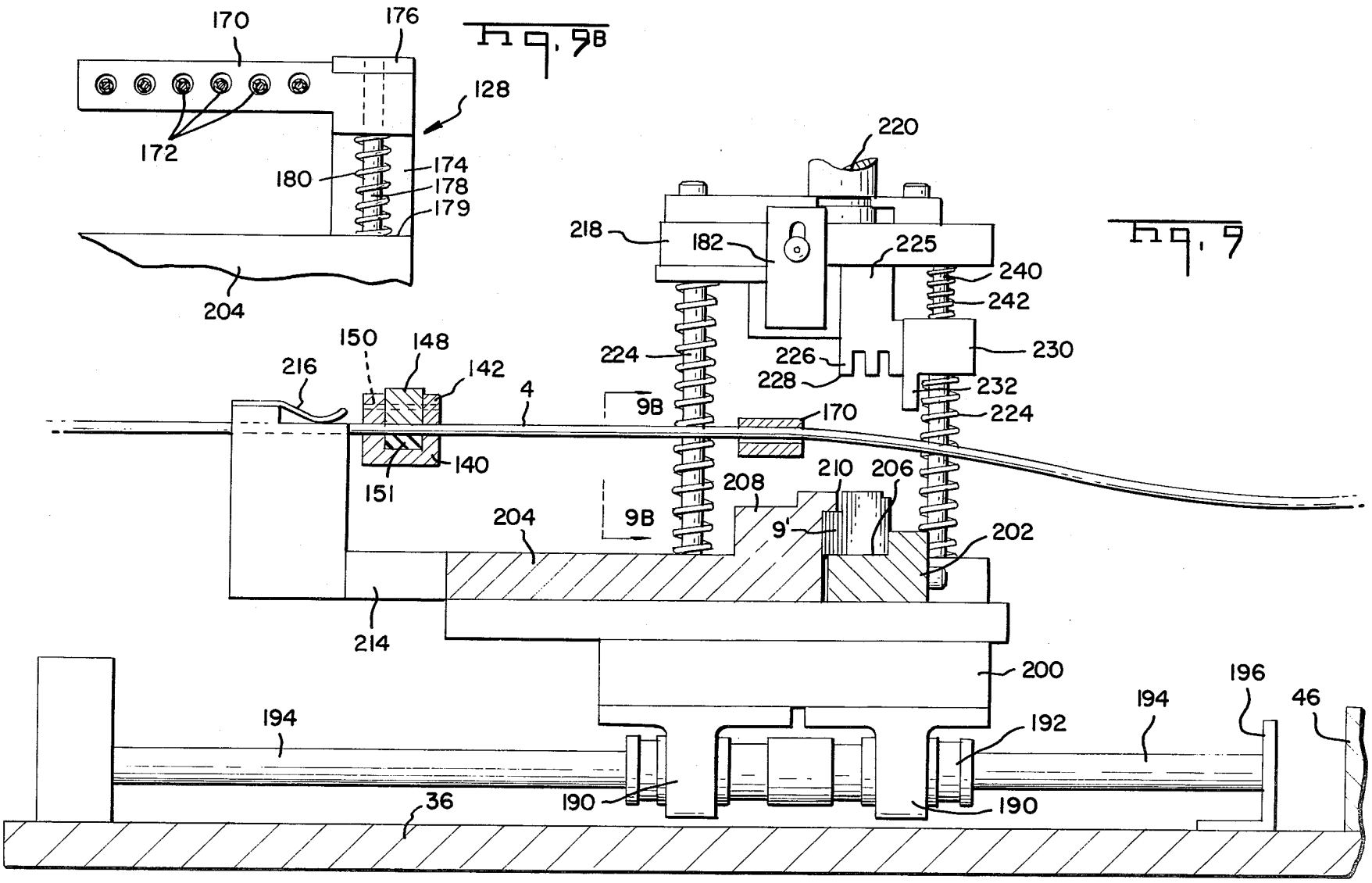
FIG. 9 is a frontal view of the first wire insertion station which appears on the left in FIG. 3.
FIG. 9B is a fragmentary view taken along the lines 9B—9B of FIG. 9.

The wire guide assembly 128 is also mounted on a slidable carriage 158 on the guide bar 130. The carriage 158 has a high friction lost motion connection to the carriage 136 by means of a connecting strap 160 which is secured to the forwardly facing side of the carriage 158 and which extends past the carriage 136. An elongated slot 162 is provided in this connecting strap 160 and a screw which is threaded into the carriage 136 extends through this slot. Washers 168 are provided on this screw at the head 169 thereof and against the surface of the strap 160 and a spring 166 is interposed between these washers. This arrangement provides a firm but yieldable connection or link between the wire clamp assembly 126 and the wire guide assembly 128 so that the wire clamp assembly can move relatively towards the wire guide assembly by overcoming the friction of the connection between the carriage as will be explained below. As shown in FIG. 9B, an upwardly extending arm 174 is provided on the carriage 158 of the wire guide assembly and this arm has a flange 176 at its upper end. A guide arm 170 is slidably mounted on a pin 178 which extends between this flange and a surface portion 179 of the carriage, a spring 180 being interposed between the carriage and the end of the guide arm to permit downward movement of the guide arm from the position shown. The guide arm 170 extends transversely across the path of wire feed and has spaced apart holes 172 therein for the individual wires as shown in FIG. 5. The holes are oversized relative to the wires so that the wires can move freely through the holes as will be apparent from a comparison of FIGS. 5 and 6.

The clamping assembly and the guide assembly 128 are normally spaced apart as shown in FIG. 3 and they maintain this relationship while the wires are fed to the position of FIG. 5. Thereafter, the clamping assembly 126 moves relatively towards the guiding assembly 128 which is stopped from further movement by a suitable stop, and the wires are moved through the guide assembly and over the upper surface 66 of the templet plate as previously described and as shown in FIG. 6. After wires have been inserted into the connector 9 as shown in FIGS. 7 and 8, the shuttle assembly is returned to the position of FIG. 3 and the wires are inserted at the first insertion station 38 into the connector 9'.

The first insertion station, FIGS. 3 and 9, is provided with a press frame 184 having an upper arm 186 and a lower arm 188 which is supported on T-shaped supported members 190. The support members in turn are slidably mounted on parallel rods 194 which extend between brackets 196, 198 on the upper surface of the support plate 136. The press can thus be moved towards and away from the second insertion station 34 to vary the lengths of the wires in the harnesses. Locking collar means 192, are provided on the rods 194 to lock the first insertion station at the position desired.

In general, the first insertion station has means for supporting the connector 9' on the lower press arm 188 and it has insertion tooling mounted on the press ram although the tooling at this first station differs significantly from that of the second insertion station. Referring to FIG. 9, the connector 9' is supported between connectors support blocks 202, 204 which are mounted on the lower arm of the press frame. The block 202 has a recess 206 for reception of the connector and the block 204 has an upwardly extending portion 208 which is disposed against the lefthand side of the connector. An integral flange extends from the portion 208 of the block 204 inwardly and over the lefthand side of the connector. The upper edge 210 of this flange functions as a fixed shear for shearing the wires prior to insertion. It will be understood that the blocks 202, 204 locate the smaller connector 9' with the wire receiving portions of the terminals in alignment with the insertion punches of this insertion station which are described below.

It is desirable to provide static guide means as shown at 216 to approximately guide the wires at the lefthand end, as shown in FIG. 3, of the apparatus. This guide means comprises a block mounted on the ends of rods 214 which extend from the positioning block 204. A resilient plate 216 is secured to the upper surface of the guide block and holds the wires against this surface as they enter the apparatus from the left in FIG. 3.

The wire positioning and insertion tooling at the first insertion station is mounted on an upper tooling block 218 which is secured to the lower end of a press ram 220. The ram is lowered by a suitable crank 222 which may be mounted on a shaft as shown which has a gear keyed thereto (not specifically shown) which engages teeth on the ram 220. The upper tooling block is guided towards and away from the lower tooling by guide rods 224 and springs as shown normally bias this upper tooling block to its raised position.

The individual wires are inserted into the connector 9' by insertion fingers 226 which are integral with, and extend from, a block 225 which is secured to tooling plate 218. The edge 228 of the insertion fingers which are on the left in FIG. 9, serve as a movable shearing edges which cooperate with the edge 210 of the block 204. The inserters may otherwise have the profile of the previously described inserters at the second insertion station.

At the time of insertion, the wires will be in generally parallel spaced-apart relationship and the distances between the wires will be approximately uniform, however, it is desirable to provide means for precisely locating the wires immediately prior to insertion. Such precise location of the wires is achieved by a floating wire positioning means which comprises a block 230 having a depending flange 232. The flange has spaced-apart slots 234 which receive the wires. Block 230 has pins 240 extending upwardly therefrom which extend slidably through the tooling block 218 and are normally biased downwardly to the position shown in FIG. 9 by springs 242.

At the beginning of an operating cycle to produce the harness of FIG. 2, the shuttle assembly 42 will normally be at the leftward limit of its travel and against the collar 134. The wires will extend over the static wire guide, into the clamping assembly 126, through the guide arm 128, and their ends will extend forwardly from the guide arm. The operator first swings the clamping member 150 (FIG. 4) in a counterclockwise direction to clamp the wires in the clamping members 126 and he then moves the entire shuttle rightwardly in FIG. 3 until the carriage 158 moves against the block 54. At this stage, the clamp assembly 126 will be spaced from the guide arm 170 and the operator continues to move the clamping assembly rightwardly which movement is permitted by virtue of the lost motion connection 160, 162 between the clamping and guiding assemblies. During this portion of the cycle, the wires are moved over the upper surface of the templet plate 64 as previously described, they are rolled into the grooves 70', and the ram 106 is lowered to lower the crosshead 86 and insert the wires into predetermined terminals in the connector 9. The ramp portion 80 of the upper surface 66 of the templet plate 64 ensures that the individual wires will be properly inserted during the descent of the ram into the terminals. As mentioned above, the wires will extend beneath the ridge 78 but the extreme end portions of the wires may be above the inclined ramp portions 80 of the templet plate. During the final stages of the downward movement of the inserter 82, the wires are first contacted by the lefthand edges of the lefthand fingers 84 of the inserters. Thereafter, the wires are further depressed and the points of contact between the wires and the edges of the slots 70 move progressively rightwardly, as viewed in FIG. 5, the wires thereby are moved progressively into the slots.

The operator then swings the clamping arm 150 through a clockwise arc to unclamp the wires and he moves the shuttle back to the original position against the collar 134. Advantageously, he should move the guide carriage to the position shown in FIG. 3 relative to the clamping assembly 126 so that the portions of the wires which are immediately adjacent to the connector 9' will be held in the guide arm 170. The operator then turns the crank 222 to lower the ram 220 and move the inserters 226 towards the connector 9'. During this portion of the cycle, the wires enter the slots 234 in the flanges 232 and are precisely located in alignment with the terminals in the connector 9'. Subsequently, the wires are sheared by the edges 210, 228 and inserted into the terminals of the connector. It will be apparent that the floating block 230 will remain stationary during the final stages of insertion while the inserters 226 move downwardly. During this final stage of the operating cycle, the deflector plate 182 moves against the guide arm 170 and lowers this arm as the wires are inserted and severed. The completed harness as shown in FIG. 2 is then removed from the apparatus.

If it is desired to produce a harness as shown in FIG. 14 which has wires extending from the connector 9 to each of 2 connectors 9' and 9'', a second apparatus is provided for the second set of wires which extend to the connector 9''. The slots 70 of the templet plate 64 of this second apparatus would be arranged to position the ends of th wires in alignment with the remaining terminals in the connector 9.

The several aspects of the invention described above can be used in combination with each other, as herein disclosed, or selected features can be used separately or in combination with further types of wire handling and/or connecting means. For example, the slotted templet plate permits separation of wires and location of their ends in precise positions and a templet plate of this type can be used as a part of a simple manually operated branch type insertion apparatus. The operator would manually locate the wires on the templet plate and lower the press ram to separate them and insert them into a connector. The templet plate can also be used in combination with an apparatus for manufacturing harnesses in which the conductors are ribbon cables (single cables having a plurality of wires in side-by-side relationship) and such an apparatus would include means for slitting the cable between adjacent wires prior to rolling of the wires over the templet plate. The combination of a wire shuttle as herein disclosed and at least one insertion station can be used for many types of harness making operations in which a second connector, the connector 9', is not required. In this instance, the wires could be simply cut after return movement of the shuttle to its starting position or they could be cut and stripped for subsequent attachment to individual terminals.

What is claimed is:

1. Apparatus for inserting wires into the wire-receiving portions of electrical contact terminals, said terminals being contained in an electrical connector or the like, each terminal having wire-receiving portions which receive a wire upon movement of said wires laterally of its axis and into said wire receiving portions, said wire receiving portions being in side-by-side relationship, said wire receiving portions facing in a common direction, said apparatus comprising:

a wire guiding templet comprising a plate-like member having oppositely facing first and second surfaces, a plurality of wire guiding slots extending across said member from one edge thereof, each of said slots extending entirely through said surface from said first surface thereof to said second surface thereof, each of said slots having a width which is sufficient to permit passages therethrough of one of said wires, each of said slots having a dead end, connector locating and supporting means proximate to said second surface for locating said connector adjacent to said second surface with each of said wire-receiving portions being proximate to one of said dead ends, wire insertion means normally spaced from said first surface, said wire insertion means being movable towards said first surface and through said dead ends of slots, said wire insertion means being effective to move wires disposed in said slots through said slots, beyond said second surface and into said wire-receiving portions of said terminals and, wire pressing means, said wire pressing means being moveable across said one surface from a location adjacent to said one edge thereof to a location which is proximate to, but spaced from, said dead ends of said slots, said wire pressing means being effective during movement across said surface to move wires positioned thereon progressively into said slots until end portions of said wires are adjacent to said dead ends of said slots and in alignment with wire receiving portions of terminals in a connector located on said connector locating and supporting means whereby, upon locating said connector is said connector locating and supporting means, locating portions of said wires proximate to said first surface and proximate to said one edge of said plate like member, and upon locating each of said wires in one of said slots, and upon applying a pressing force against said wires by said pressing means and moving said pressing means across said surface from said one edge, said wires are progressively moved into said slots until portions of said wires are adjacent to said dead ends and are in alignment with said wire receiving portions of said terminals, and upon movement of said wire inserting means towards said first surface and through said slots, said wires are inserted into said wire-receiving portions of said terminals.

2. Apparatus as set forth in claim 1, said pressing means comprising a roller.

3. Apparatus as set forth in claim 1, at least one of said slots extending from said one edge in non-parallel diverging relationship with respect to an adjacent one of said slots.

4. Apparatus as set forth in claim 1, said slots extending from said one edge in non-parallel diverging relationship across said templet, said dead ends being in side-by-side spaced apart relationship.

5. Apparatus as set forth in claim 1, said connector locating and supporting means comprising block means having a connector supporting and locating surface portions, said templet being secured to said block means and extending therefrom, said one edge being remote from said connector locating and supporting surface portions.

6. Apparatus as set forth in claim 5, said wire insertion means being mounted on, and normally spaced from, said block means.

7. Apparatus as set forth in claim 2 including actuating means for moving said roller across said one surface and for thereafter moving said insertion means towards said one surface.

8. Apparatus as set forth in claim 1 including wire feeding means for feeding wires along a wire feed path from substantially endless sources to said templet and for locating portions of said wires proximate to said one edge of said templet.

9. Apparatus as set forth in claim 8 including means on said feed path for inserting said wires into another connector at a location remote from said connector and for severing said wires adjacent to said other connector.

10. Apparatus as set forth in claim 9, said wire feeding means comprising a shuttle which is reciprocable along said feed path.

11. Apparatus as set forth in claim 10, said shuttle having releasable wire clamping means for releasably clamping said wires in side-by-side parallel relationship during movement of said shuttle towards said templet.

12. Apparatus for connecting individual wires to electrical contact terminals in each of two electrical connectors, said contact terminals each having a wire-receiving portion which receives a wire upon movement of said wire laterally of its axis and into said wire-receiving portion, said wire-receiving portions in each of said connectors being arranged in side-by-side relationship in a row, said apparatus comprising:

frame means, first and second wire insertion stations on said frame means, each of said insertion stations having connector supporting means for supporting one of said connectors in a predetermined position, each of said insertion stations further having insertion means for moving wires laterally of their axes and into the wire-receiving portions of terminals in a connector in the associated connector supporting means, each of said insertion means being normally spaced from its associated connector supporting means and being movable towards and away from its associated connector supporting means, a wire feed shuttle, said feed shuttle being reciprocable along a wire feed path which extends from a location beyond said first wire insertion station to said first wire insertion station, between said connector supporting means and said wire insertion means at said first wire insertion station thence to said second wire insertion station, said feed shuttle having releasable wire clamping means for clamping wires, which extend from substantially endless sources in side-by-side relationship, said clamping means being effective to hold said wires in side-by-side co-planar relationship during movement of said shuttle towards said second insertion station whereby said wires are pulled to said second insertion station, said shuttle being effective to release said wires during return movement of said shuttle past said said first insertion station and wire severing means at said first insertion station for severing said wires whereby, upon positioning first and second connectors at said first and second insertion station, moving said shuttle to said second insertion station and then returning said shuttle to its initial position, and upon moving said insertion means to said connectors and actuating said severing means, said wires are severed and electrically connected to said terminals in said connectors.

13. Apparatus as set forth in claim 12, said feed shuttle having wire guide means thereon said guide means being normally spaced from, and in advance of said wire clamping means in the direction of wire feed towards said second insertion station, and a lost motion connection between clamping means and said guide means whereby, upon movement of said shuttle along said path towards said second insertion station, said guide means arrives at said second station prior to arrival of said clamping means and said guide means comes to rest, and upon further movement of said clamping means towards said second insertion station, said wires are moved through said guide means into said second insertion station.

14. Apparatus for inserting wires into the wire-receiving portions of electrical contact terminals, said terminals being contained in an electrical connector or the like, each terminal having wire-receiving portions which receive a wire upon movement of said wire laterally of its axis and into said wire receiving portions, said wire receiving portions being in side-by-side relationship, said wire receiving portions facing in a common direction, said apparatus comprising:

a wire guiding templet comprising a plate-like member having oppositely facing first and second surfaces, a plurality of wire guiding slots extending across said templet from one edge thereof, each of said slots extending entirely through said surface from said first surface thereof to said second surface thereof, each of said slots having a width which is sufficient to permit passages therethrough of one of said wires, each of said slots having a dead end, connector locating and supporting means proximate to said second surface for locating said connector adjacent to said second surface with each of said wire-receiving portions being proximate to one of said dead ends, wire insertion means normally spaced from said first surface, said wire insertion means being movable towards said first surface and through said dead ends of slots, said wire insertion means being effective to move wires disposed in said slots through said slots, beyond said second surface and into said wire-receiving portions of said terminals, wire feeding means comprising a shuttle for feeding wires along a said path from substantially endless sources to said templet and for locating portions of said wires proximate to said one edge of said templet, additional means on said feed path for inserting said wires onto another connector at a location remote from said connector and for severing said wires adjacent to said other connector, said shuttle having releasable wire clamping means for releasably clamping said wires in side-by-side parallel relationship during movement of said shuttle towards said templet, said shuttle further having guide means thereon, said guide means being between said clamping means and said templet, and lost motion connecting means serving to connect said clamping means to said guide means whereby, upon movement of said shuttle along said path towards said templet, said guide means arrives at said templet prior to arrival of said clamping means, and said guide means comes to rest and upon further movement of said clamping means towards said templet, said wires are moved towards said templet and guided into said one surface of said templet by said guide means thereby to locate portions of said wires proximate to said first surface and proximate to said one edge of said plate-like member, and upon applying a pressing force against said wires and moving said pressing force across said surface from said one edge, said wires are progressively moved into said slots until portions of said wires are adjacent to said dead ends and are in alignment with said wire receiving portions of said terminals, and upon movement of said wire inserting means towards said first surface and through said slots, said wires are inserted into said wire-receiving portions of said terminals and upon return movement of said shuttle, said wires can be severed adjacent to said other connector and inserted into said other connector.

* * * * *